United States Patent [19]

Stephens et al.

[11] Patent Number: 4,903,956

[45] Date of Patent: Feb. 27, 1990

[54] SHEET STACKING APPARATUS HAVING POSITIVE CONTROL SYSTEM FOR TRAILING SHEET ENDS

[76] Inventors: David J. Stephens; Rodney G. Mader; Homer D. Durst; Sven Sonnenberg, all of Diconix Inc., Dayton, Ohio 45420

[21] Appl. No.: 264,724

[22] Filed: Oct. 31, 1988

[51] Int. Cl.[4] ..... B65H 29/40

[52] U.S. Cl. ..... 271/178; 271/220

[58] Field of Search ..... 271/220, 176, 182, 178, 271/187, 314, 315

[56] References Cited

U.S. PATENT DOCUMENTS

| | | | |
|---|---|---|---|
| 2,844,373 | 7/1958 | Van Marle | 271/87 |
| 3,228,273 | 1/1966 | Huffman | 271/314 X |
| 3,847,388 | 11/1974 | Lynch | 271/174 |
| 3,954,259 | 5/1976 | Gerbasi | 271/220 X |
| 3,991,996 | 11/1976 | Bass | 271/314 |
| 4,056,264 | 11/1977 | Dhooge et al. | 271/177 |
| 4,342,325 | 8/1982 | Lundblad | 271/315 X |
| 4,518,157 | 5/1985 | Stobb | 271/315 X |
| 4,570,922 | 2/1986 | Akers | 271/178 |
| 4,638,993 | 1/1987 | Granzow | 271/315 |

*Primary Examiner*—Richard A. Schacher

[57] ABSTRACT

A sheet stacking apparatus for receiving sheets from a printing or copying machine includes guide structure for directing output sheets onto an elevator platform and a selectively rotatable shaft having paddle arms disposed at a 108° interval. The shaft rotation is controlled so that the arms guide a sheet during stacker input and then rotates 360° to positively clear the sheet trail edge from the stacker input path.

2 Claims, 5 Drawing Sheets

SHEET STACKING APPARATUS HAVING POSITIVE CONTROL SYSTEM FOR TRAILING SHEET ENDS

FIELD OF INVENTION

The present invention relates to apparatus for receiving and stacking sheets produced by output machines (for example a printer or copier), and more particularly to a system in such stacker apparatus for controlling the position of the trailing ends of sheets fed for stacking.

BACKGROUND ART

Printers and copier machines that operate with sheet media all require a structure to receive their finished sheet output. When the machines are to be capable of long runs, there often is provided a stacking apparatus (which can be either an accessory attachment or a machine subsystem) designed to receive output sheets and direct them into an orderly stack. Such stacker apparatus provides structure to guide the lead and side edges of the output sheet into the stack. A typical approach, for large quantity sheet output, is to provide an elevator platform which begins to receive sheets at a position proximate the sheet egress region of the output machine and gradually lowers. This enables the top sheets of the stack, which builds up on the platform, to remain at the proper sheet receiving location near the output machine's egress, so that the leading edge of newly output sheets can be guided into a proper position.

Because sheets do not have substantial rigidity, the trailing edge of the fed sheets cannot be depended upon to fall neatly into position on the stack top. For example, sheet curl, air cushion effects and side guide contacts can cause the sheets' trailing edge to remain upward from the stack top. A serious paper jam condition evolves if the trail end of the stack's top sheet remains sufficiently upward that it blocks the next output sheet.

The typical prior art approach for solving such trailing edge problems, has been to provide a continuously rotating roller with traction surface or flapper portions that direct the trailing edge of sheets downwardly onto the stack face. U.S. Pat. No. 4,056,264 discloses several configurations for implementing this approach. However, the provision of any continuously rotating impeller construction along the path from the output device to the stack necessarily creates a zone of constricted passage in the path and, thus, itself presents a potential for jamming.

SUMMARY OF THE INVENTION

A significant purpose of the present invention is to provide a new approach for positively controlling the trail edge of sheets fed onto a stacker apparatus, without causing any constriction or obstruction along the sheet output feed path.

In one embodiment the present invention constitutes a sheet stacking apparatus comprising a hopper having walls for indexing the lead and side edges of a fed sheet into proper stack position; guide members for directing the lead edge of a sheet fed from an output machine into indexed relation within the hopper; a paddle assembly mounted for rotation proximate the egress of the guide means; and means for selectively rotating the paddle assembly, after the lead portions of a fed sheet have been fed therepast, to positively force the trail edge of such sheet toward the top of the sheet stack.

BRIEF DESCRIPTION OF DRAWINGS

The subsequent description of preferred embodiments of the invention refers to the accompanying drawings wherein.

DETAILED DESCRIPTION OF PREFERRED EMBODIMENTS

Figure 1:
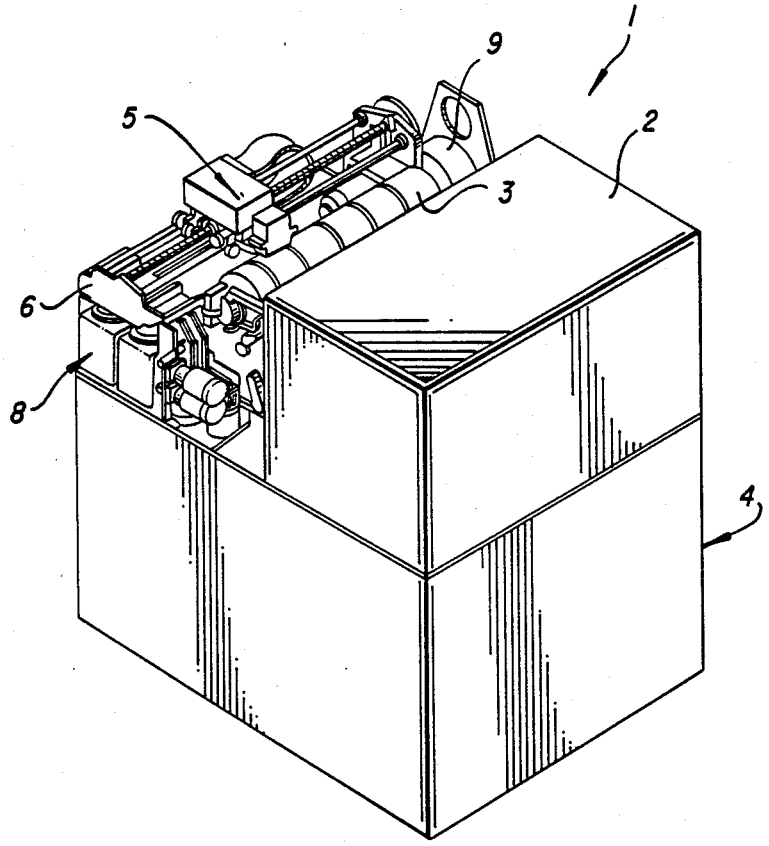
FIG. 1 is a perspective view showing one kind of sheet printing output machine with which the present invention is useful.

The printer/stacker system shown in FIG. 1, in general, comprises an ink jet printer machine 1, a sheet supply and feeder assembly 2 and a sheet stacking apparatus 4. The sheet feeder and sheet stacker can be constructed as modules which connect to the printing machine or they can be constructed on a common mainframe with the printer machine. The mechanical structure of the sheet feeder 2 does not involve any direct cooperations with the present invention and will not be described in detail. Any feeder which sequentially feeds sheets to the print platen on signal from a system controller is applicable. The structure described in U.S. Pat. No. 4,645,195 is exemplary.

The printer 1 shown in FIG. 1 is a continuous ink jet printer of the traversing head kind. In general, ink is supplied to a print head 5 from supply cartridge 8. The print head traverses a print drum 3 to print lines (on sheet media fed onto the drum from sheet supply 2). As the print head traverses on carriage 6, a motor 9 provides drive to rotate the drum 3. Such a printer is described in more detail in U.S. Pat. No. 4,591,870; however, sheet stacker apparatus according to the present invention can be usefully employed with various other printers, as well as copiers, e.g., electrographic apparatus.

Figure 2A:
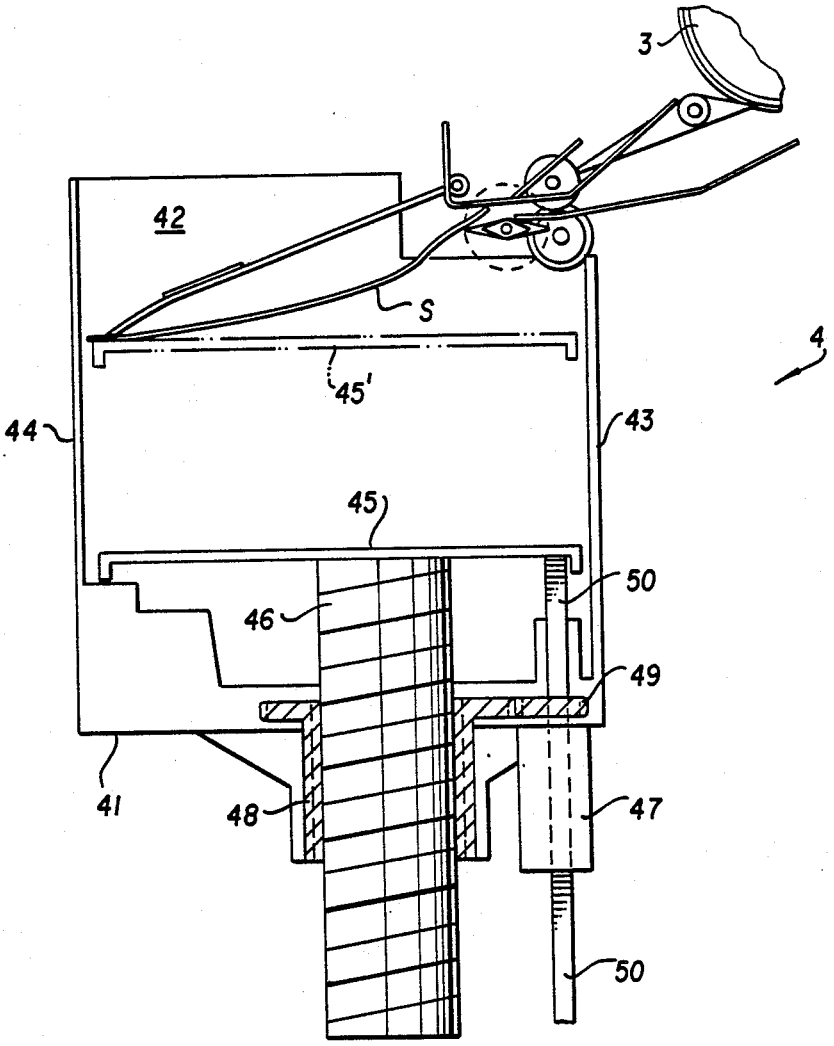
FIG. 2A is a side elevation of a portion of the FIG. 1 machine showing one preferred stacker apparatus embodiment of the present invention.

Referring now to FIG. 2A, it can be seen that the stacker apparatus 4 comprises a mainframe having bottom wall 41, front and rear walls 43, 44, and side walls 42. A sheet support platform 45 fits for sliding movement up and down within the walls and a threaded column 46 is attached to its bottom surface. A rotatable gear 48, journalled in bottom wall 41 supports shaft 46, is driven by motor 47 via gear 49 to raise and lower column gear 46 and thus platform 45. Guide shaft 50 slides in the mainframe bottom wall and is coupled to platform 45 to prevent the platform from turning during rotation of gear 48. The motor 47 is controlled by a paper level detector 61 and control circuit 60 (see FIG. 4) to maintain the top of the stack accumulating on platform 45 at the level shown by the phantom line platform 45' in FIG. 2A.

Figure 2B:
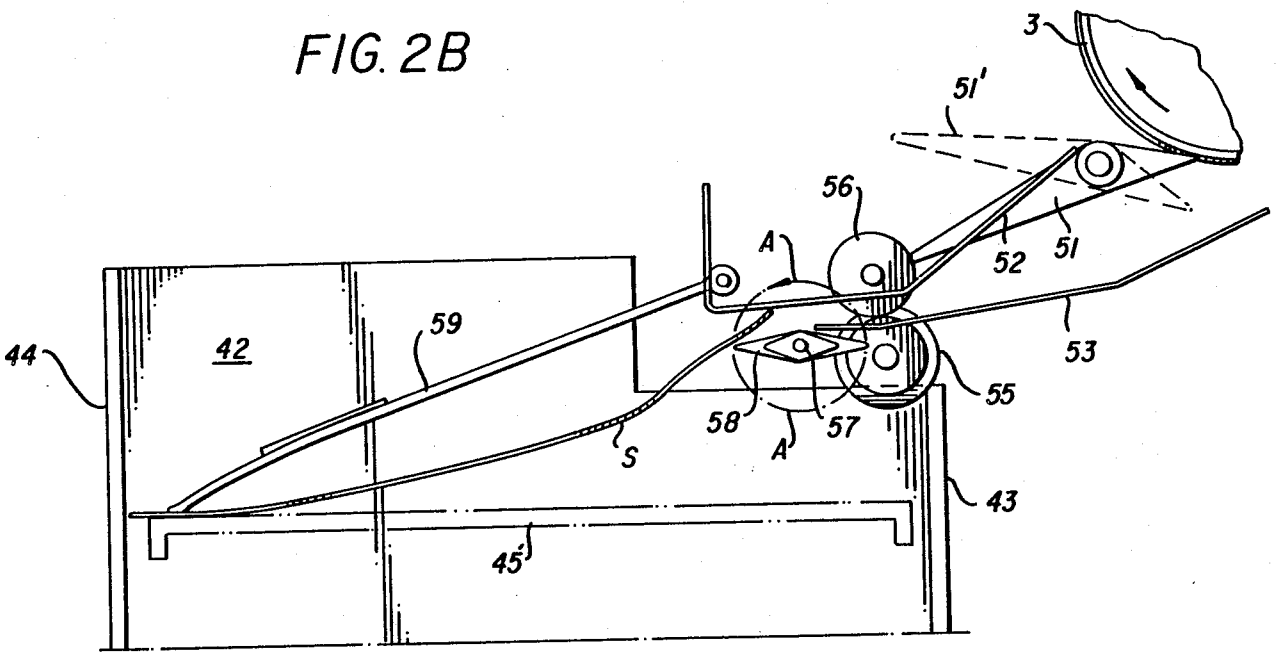
FIG. 2B is an enlarged view of a portion of the FIG. 2A apparatus.

Referring now to FIG. 2B, it can be seen that a stripper element 51 is rotatably mounted proximate printer drum 3 to move between the strip and guide position shown in solid lines and the inactive position shown in phantom at 51'. When moved to the solid line position, stripper element 51 directs an output sheet S, which has been printed on drum 3, into the guide path leading from the printer to the stacker apparatus. The guide path is mainly defined by upper guide member 52 and lower guide member 53; however, exit drive roller 55 and idler roller 56 form a nip near the end of the lower guide member 53 to provide sheet drive into the top region of the stacker, after lead sheet portions pass into the roller's nip.

Figure 3:
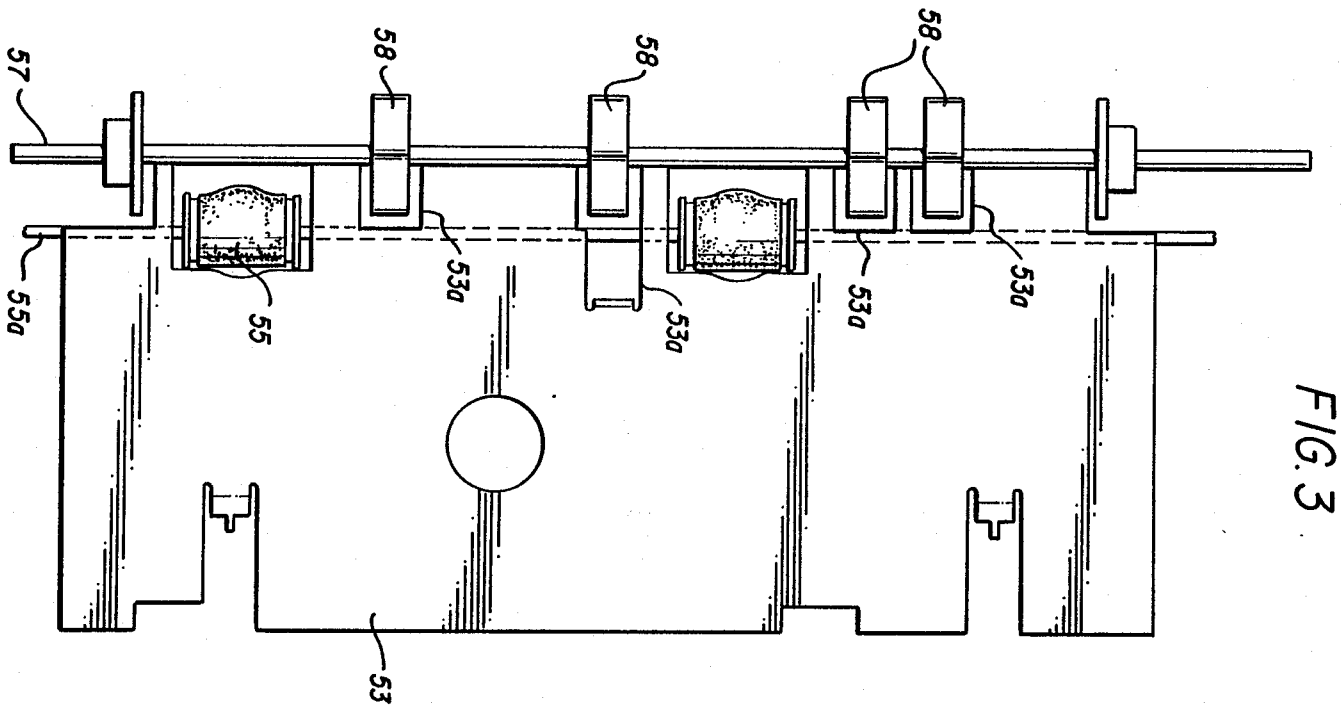
FIG. 3 is a top view of a portion of the sheet stacker structure shown in FIG. 2B.

In accord with the present invention, a paddle assembly is provided to positively control the trail ends of sheets that pass through the nip of rollers 55, 56. More specifically, the paddle assembly comprises a rotatable shaft 57, mounted within the stacker apparatus slightly below and forward of the exit end of lower guide member 53, and a plurality of paddle arms 58 attached for rotation with shaft 57. The arms 58 extend from opposite sides of shaft 57, with an intervening angle of about 180°, so that their upper surfaces, as viewed in FIG. 2B, form a generally flat guide extension generally below and forward of guide member 53. FIG. 3 is a top view of a portion of the guide member 53 and shows that portions of the guide members 53 which overlie the paddle arms 58 are notched **53*a* so that the paddle arms can pass through the notches (along the path indicated by arrows A in FIG. 2B) when shaft 57 is rotated. Upper guide member has similar notch structure and shaft 55*a* for drive roller 55 is located outside of the rotary path of the paddle arms as shown in FIG. 3. Shaft 57 can be coupled to a separate motor or can be clutch-connected to other drive trains of the printer/stacker system for selective rotation of the paddle arms 58**.

Figure 4:
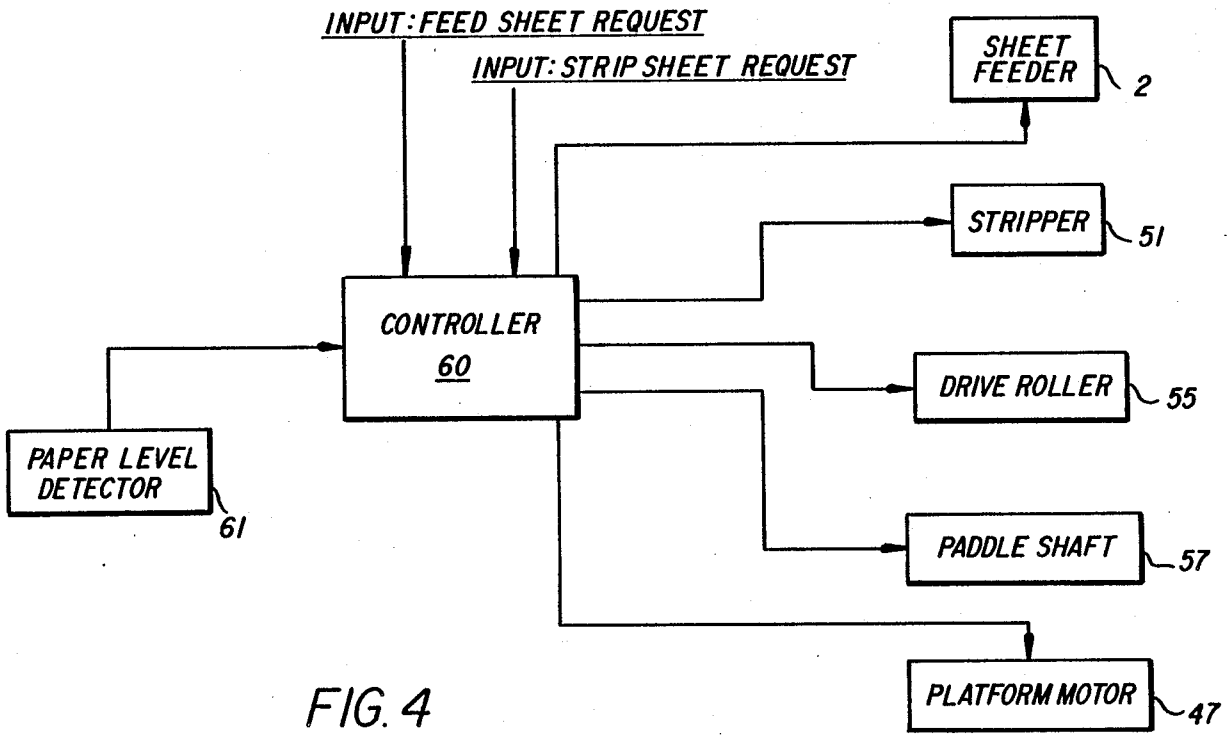
FIG. 4 is a block diagram showing one preferred control system for effecting actuation of paddle wheel rotation in proper synchronization with sheet feed into the stacker apparatus shown in FIG. 2A.

The function of the paddle assembly in cooperation with the sheet output operation of printer 1 and other portions of the stacker apparatus 4 can be further understood by description of its operation under the control of system controller 60 shown in FIG. 4. Thus, after completion of sheet printing on drum 3, a printer system supervisory controller, e.g. in a microcomputer, so signals stacker controller 60. In response, stacker controller 60 signals rotation of stripper 51 to the solid line position of FIG. 2A and actuates rotation of drive roller 55. The lead end of a sheet is directed by stripper 51 into the egress path between guide members 52, 53 and thence into the nip of rollers 55, 56. These exit rollers feed the sheet over paddle assembly (which is then in the solid line position of FIG. 2A) so that the lead sheet edge is fed over the top of the stack on platform 45 and, under the guide constraint of pivot guide 59, into engagement with rear wall 44 of the stacker apparatus frame. Wall 44 and guide 59 index the lead edge of the sheet to proper stack position and side walls 42 direct the side edges of the sheet so that they are neatly aligned. At this stage the sheet S is generally in the position shown in FIG. 2A, with its trail edge out of the nip of rollers 55, 56 and resting between paddle arms 58 and upper guide member 52.

After sufficient time for such sheet passage, following initiation of stripper 51, controller 60 signals a rotation of 360° of shaft 57. In one preferred embodiment, 0.30 seconds is sufficient time for a sheet S to travel from drum 3 to rear wall 44. During the 360° rotation the trailing edge of sheet S is positively moved from a position on the feed path above arms 58 to a position below the feed path below arms 58. The trail sheet edge can then settle onto the stack face while the feed path is assuredly clear for stack feeding of the next successive printed sheet. As the sheet stack builds detector signals controller 60 to progressively lower platform 45 (via motor 47) so that successive sheets fed for stacking encounter generally the same sequence as described above.

The invention has been described in detail with particular reference to preferred embodiments thereof, but it will be understood that variations and modifications can be effected within the spirit and scope of the invention.

We claim:

1. In a sheet stacking apparatus having means for supporting a plurality of sheets from an output device and wall means for directing such sheets into an orderly stack, an improved device for positively controlling the trailing edge of sheets successively fed into said wall means, said device comprising:

(a) means, including upper and lower guide members defining a sheet guide path with an outlet end located above said supporting means, for directing the leading edge of an incoming sheet from an inlet side of said wall means toward an opposite, abutment side of said wall means;

(b) trail edge control means including a shaft rotatably mounted adjacent the outlet end of said lower guide member and a pair of paddle arms extending from said shaft at 180° to each other, said shaft being located and said arms being constructed so that in a first position said arms are generally coplanar with said lower guide member;

(c) drive means for selectively rotating said shaft in 180° increments from said first position; and (d) means for synchronizing actuation of said drive means with sheet feed along said sheet guide path so that said paddle arms remain in said first position during passage of a leading sheet edge and subsequently rotate one 180° increment to positively move the trail edge of such sheet out of said path and toward the stack top.

2. The invention defined in claim 1 where the outlet ends of said sheet guide members have notches aligned with said paddle arms to allow said arms to rotate through the outlet end of said sheet feed path.

* * * * *

UNITED STATES PATENT AND TRADEMARK OFFICE

CERTIFICATE OF CORRECTION

PATENT NO. : 4,903,956

DATED : February 27, 1990

INVENTOR(S) : Stephens et al

It is certified that error appears in the above-identified patent and that said Letters Patent is hereby corrected as shown below:

On the title page add the following:

Assignee: EASTMAN KODAK COMPANY
Rochester, New York

Attorney, Agent or Firm: John D. Husser

Signed and Sealed this

Fifth Day of February, 1991

*Attest:*

HARRY F. MANBECK, JR.

*Attesting Officer*

*Commissioner of Patents and Trademarks*